US007648375B1

(12) United States Patent
Jiang

(10) Patent No.: US 7,648,375 B1
(45) Date of Patent: Jan. 19, 2010

(54) SLIDING COVER FOR ELECTRICAL SOCKETS

(76) Inventor: Peigen Jiang, 19480 SE. 28th Pl., Sammamish, WA (US) 98075

( * ) Notice: Subject to any disclaimer, the term of this patent is extended or adjusted under 35 U.S.C. 154(b) by 0 days.

(21) Appl. No.: 12/429,191

(22) Filed: Apr. 24, 2009

(51) Int. Cl.
*H01R 13/44* (2006.01)

(52) U.S. Cl. ..... 439/136; 439/373; 220/345.3; 220/348

(58) Field of Classification Search ..... 439/136, 439/373; 220/323, 345.1, 345.2, 345.3, 348; 174/66, 67
See application file for complete search history.

(56) References Cited

U.S. PATENT DOCUMENTS 2,516,464 A * 7/1950 Hooser ..... 174/67
5,080,222 A * 1/1992 McNary ..... 206/1.5

* cited by examiner

*Primary Examiner*—Tho D Ta

(57) ABSTRACT

An electrical socket safety device is disclosed which comprises a base plate for an electrical receptacle exposing multiple electrical sockets thereon, a sliding plate slidably engaging the base plate for covering the electrical sockets, a spring urged to protrude through a slot in the base plate, a concave space on the sliding plate for accommodating the protruding spring, the concave space forcing a first slope on the spring to depress the same into the slot when the sliding plate sliding in one direction, the concave space forcing a second slope of the spring to depress the same into the slot when the sliding plate sliding in an opposite direction, wherein the engagement of the concave space and the spring holds the sliding plate in a predetermined position, and the disengagement of the concave space and the spring requires a predetermined amount of force.

19 Claims, 3 Drawing Sheets

SLIDING COVER FOR ELECTRICAL SOCKETS

BACKGROUND

The present invention relates generally to electrical sockets, and, more particularly, to electrical sockets with safety covers.

Electrical sockets for supplying electrical power to electrical equipments are common fixtures in homes and other buildings. Electrical sockets of conventional electrical receptacles are exposed, that poses a child safety hazard, as curiosity may induce a child to insert objects into openings of the electrical sockets, and get injured or even be killed.

Because of this safety hazard, many devices to limit children's access to the receptacles have been designed and marketed. For example, plastic safety plugs with prongs that fit snugly into the openings of an electrical socket are readily available on the market. But it is not convenient to always have to unplug and plug such a plastic safety plug when one needs to use an electrical socket.

Other safety devices for electrical outlets are known in the art. For example, U.S. Pat. No. 7,094,969 issued to In provides a base plate with a top panel, on which a spring loaded locking means is devised. A sliding cover plate joins the top panel and is locked by the spring loaded locking means when the sliding cover plate is in the closed position to limit access to the electrical outlet. Although this device offers secured covering of the electrical outlets, it may not be very cost effective as a top panel on the base plate is added.

U.S. Pat. No. 6,342,676 issued to Ha teaches a safety guard device for an electrical socket which comprises a base plate and a sliding cover plate. The sliding cover plate contains an aperture which is positioned to provide selective registry with at least one aperture in the base plate and thus access to the electrical receptacle. Such aperture on the sliding cover plate requires a complicated alignment mechanism between the base plate and the sliding cover plate and also makes the cover plate less ornamental.

As such, what is desired is an electrical socket safety cover that is secure and easy to operate, as well as makes the electrical socket less conspicuous.

SUMMARY

This invention discloses an electrical socket safety device which comprises a base plate for an electrical receptacle exposing multiple electrical sockets thereon, a sliding plate slidably engaging the base plate for covering the electrical sockets, a spring urged to protrude through a slot in the base plate, a concave space on the sliding plate for accommodating the protruding spring, the concave space forcing a first slope on the spring to depress the same into the slot when the sliding plate sliding in one direction, the concave space forcing a second slope of the spring to depress the same into the slot when the sliding plate sliding in an opposite direction, wherein the engagement of the concave space and the spring holds the sliding plate in a predetermined position, and the disengagement of the concave space and the spring requires a predetermined amount of force.

The construction and method of operation of the invention, however, together with additional objectives and advantages thereof will be best understood from the following description of specific embodiments when read in connection with the accompanying drawings.

DESCRIPTION

The present invention discloses an electrical socket safety device that includes a sliding cover for covering the electrical socket when it is not being used. The sliding cover is retained in place by one or more retention springs, and can easily slide up and down by a school age or older person but not by a small child. Because the sliding cover has a smooth surface, when covering the electrical socket, it also provides an ornamental utility to the electrical socket.

Figure 1:
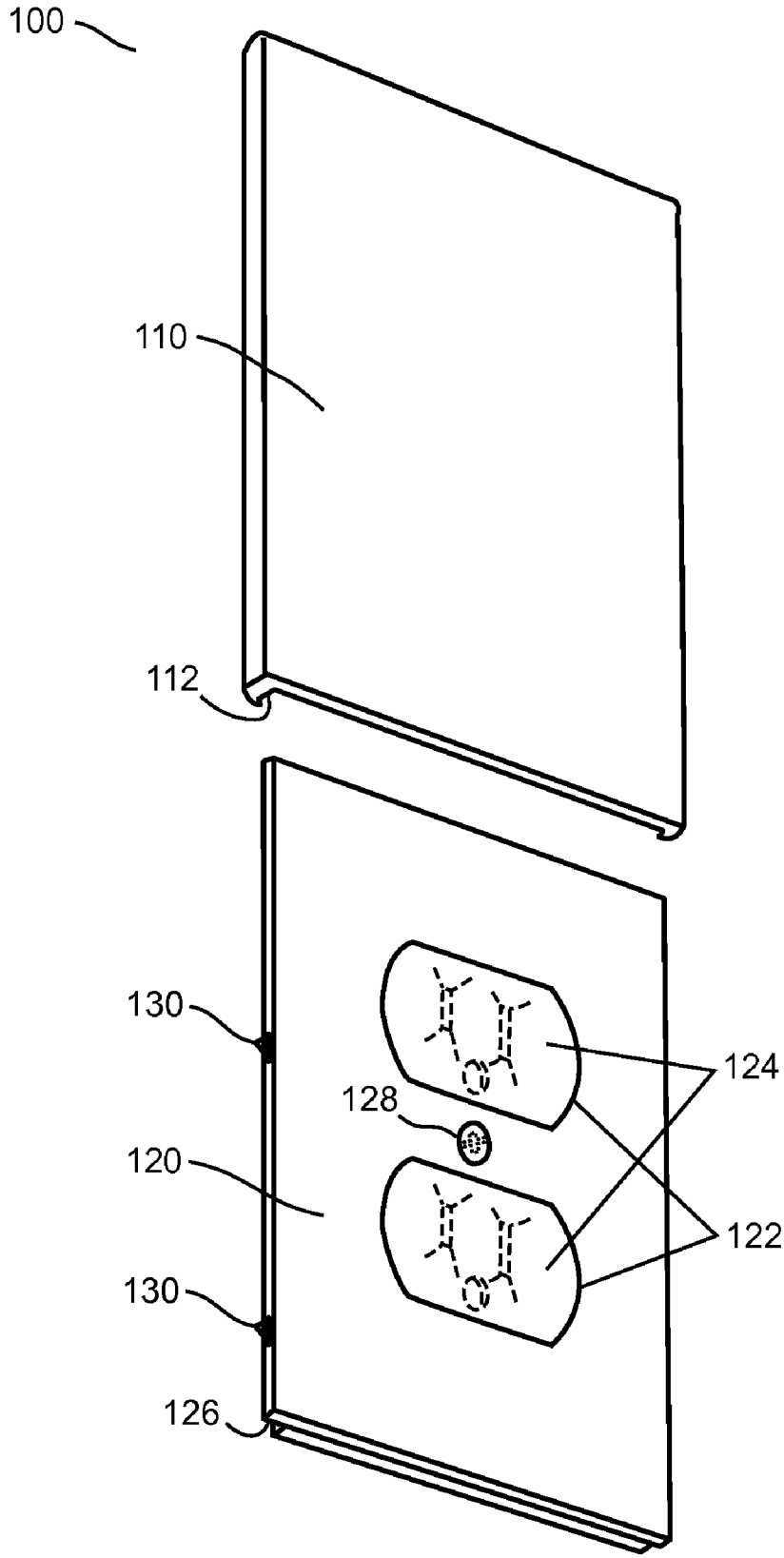
FIG. 1 is a perspective view of an electrical socket safety device according to one embodiment of the present invention.

FIG. 1 is a perspective view of an electrical socket safety device 100 according to one embodiment of the present invention. The electrical socket safety device 100 has a sliding cover 110, slidably engaging an electrical socket base plate 120. Since a standard electrical receptacle has two sockets, the base plate 120 has two apertures 122 for exposing the two electrical sockets 124, respectively. The surface of the base plate 120 is approximately flush with surfaces of the electrical sockets 124. Each vertical side of the sliding cover 110 has an internally facing groove 112 that is designed to fit over a vertical edge 126 of the base plate 120, so that the sliding cover 110 can slide up and down the base plate 120 with the guidance of the groove 112 and the vertical edge 126. In this case the sliding cover 110 is wider than the base place 120.

Referring again to FIG. 1, there are two protruding retention springs 130 on each vertical edge 126 of the base plate 120. The retention springs 130 fit into concave spaces (not shown in FIG. 1) on the groove 112. When a retention spring 130 fits into a concave space, with the urge of the spring force from the retention spring 130, the sliding cover 110 is held in a predetermined position. The spring force is strong enough that a small child cannot slide the sliding cover 110, but weak enough for an older kid, and of course an adult to slide the sliding cover 110. A small child is generally regarded as a pre-school age kid, who may not comprehend the danger of electricity, and they are primarily the people the safety device of the present invention is intended to protect. The retention springs 130 and the concave spaces are so placed, the sliding cover 110 can be retained either covering both the electrical sockets 124 or covering only one of the electrical sockets 124.

Although the sliding cover 110 having the grooves 112 is described, one having skills in the art would recognize that the base plate 120 may instead have internally facing grooves that may fit vertical edges of a sliding cover. In this case the sliding cover is narrower than the base plate.

Figure 2:
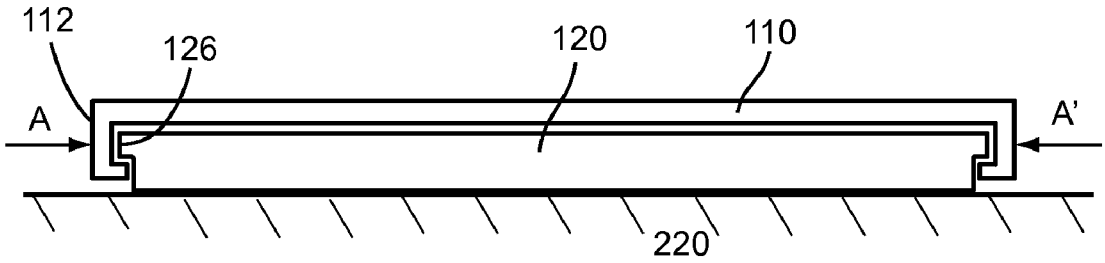
FIG. 2 is a side view from the bottom of the electrical socket safety device.

FIG. 2 is a side view from the bottom of the electrical socket safety device 100 of FIG. 1. The electrical socket safety device 100 has symmetrical sides. An edge 126 of the base plate 120 fits in a groove 112 of the sliding cover 110.

The base plate 120 with a predetermined thickness is mounted against a wall 220, so that the groove 112 of the sliding cover 110 does not contact the wall 220 for easy sliding.

Figure 3:
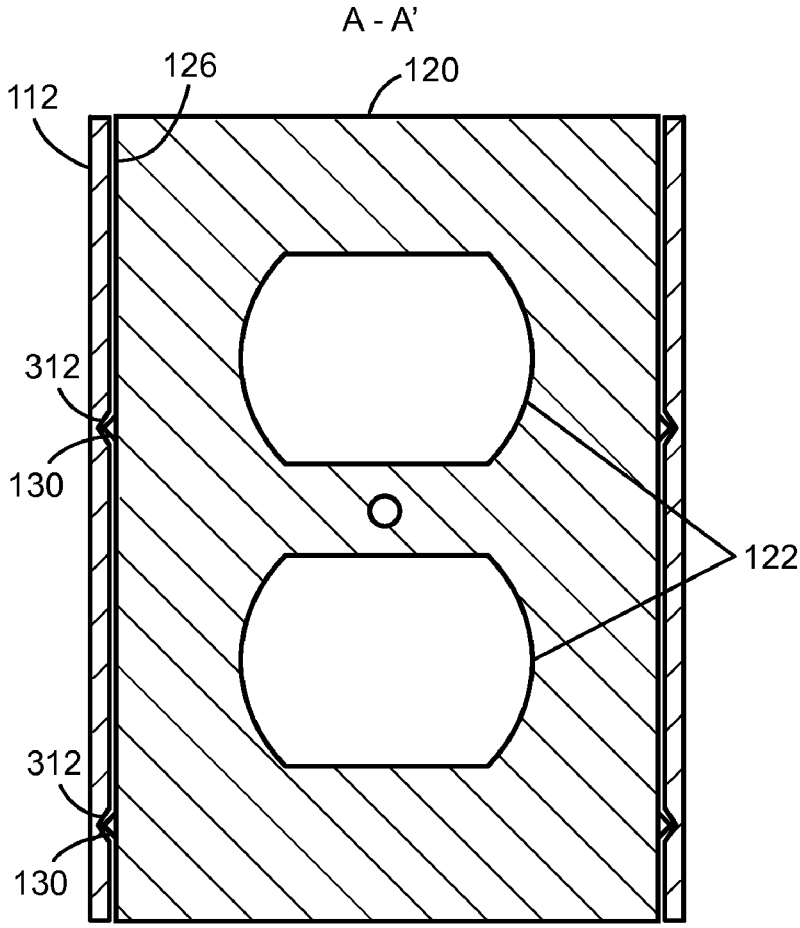
FIG. 3 is a cross-sectional view of the electrical socket safety device.

FIG. 3 is a cross-sectional view of the electrical socket safety device 100. The cross-section is taken at the A-A' plane as shown in FIG. 2. The electrical socket safety device 100 is conventionally made symmetrical. The retention springs 130 protrude from the edges 126 of the base plate 120. Corresponding concave spaces 312 on the grooves 126 receive the protruding retention springs 130, respectively. The combination of the protruding retention springs 130 and the concave spaces 312 serves to hold the sliding cover 110 in predetermined vertical locations. As shown in FIG. 3, when the sliding cover 110 which is represented by the grooves 112 covers both electrical socket apertures 122, all the retention springs 130 and the concave spaces 312 are engaged. When the sliding cover 110 slides upward exposing the bottom electrical socket aperture 122, only the lower pair of the concave spaces 312 engage the upper pair of the protruding retention springs 130. The sliding cover 110 can slide all the way out of the base plate 120, and then both the electrical socket apertures 122 are exposed.

Figure 4:
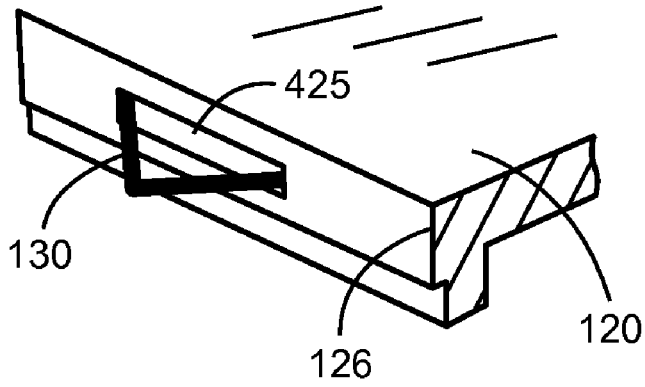
FIG. 4 is close-up prospective view of a retention spring on the side of the electrical socket base plate.

FIG. 4 is close-up prospective view of a protruding retention spring 130 on the edge 126 of the electrical socket base plate 120. There is a slot 425 on the edge 126 of the base plate 120. The retention spring 130 protrudes from the slot 425 at the urge of the spring force, and can be pushed back into the slot 425 (not shown in FIG. 4).

Figure 5A:
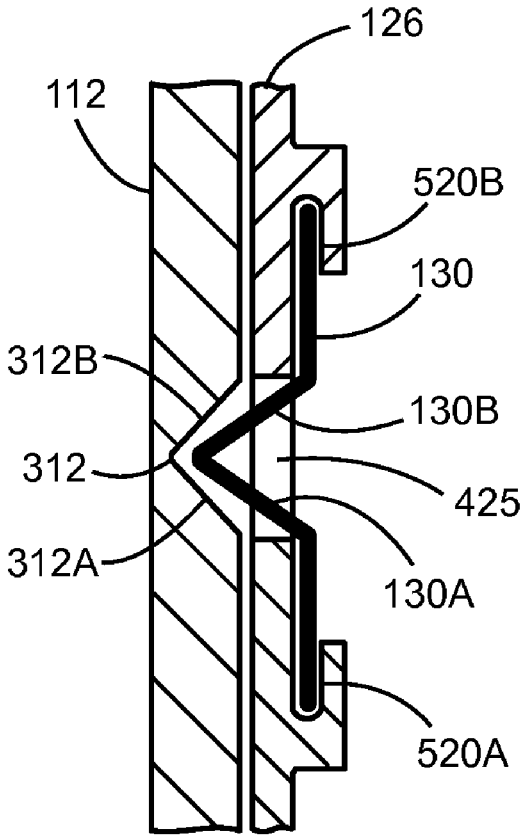
FIGS. 5A and 5B are cross-sectional views illustrating the retention spring engaging the sliding cover.
Figure 5B:
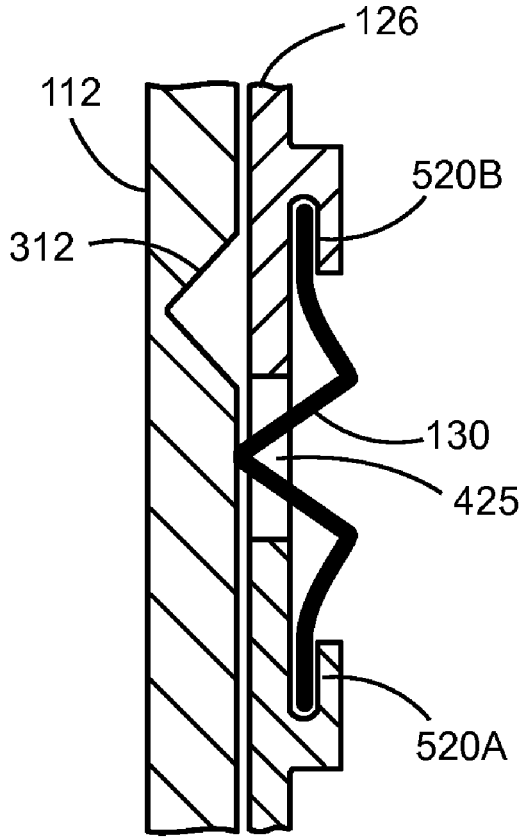

FIGS. 5A and 5B are cross-sectional views illustrating the retention spring 130 engaging and disengaging, respectively, the concave space 312 on the groove 112 of the sliding cover 110. Referring to FIG. 5A, the retention spring 130 is a wire or plate spring that is permanently bent into a "V" shape with a straight portion extended from each tip of the "V". Slopes 130A and 130B of the V-shaped retention spring 130 are preferably symmetrical because the sliding cover needs to slide in both up and down directions. The upper and lower ends of the retention spring 130 are fastened to the base plate 120 by clamp-like-fixtures 520A and 520B, respectively. The clamp-like-fixtures 520A and 520B are formed as part of the base plate 120 when the base plate 120 is made of a plastic material through an injection process. The ends of the retention spring 130 are squeezed in tightly fit gaps of the fixtures 520A and 520B, respectively, and are fastened securely thereby.

Referring again to FIG. 5A, the concave space 312 in the groove 112 has a shape that allows it to accommodate the protruding part of the retention spring 130. As shown in FIG. 5A, the slopes 312A and 312B on the surface of the concave space 312 serves to facilitate the sliding of the sliding cover 110 while overcoming the spring force of the retention spring 130. Similar to the slopes 130A and 130B, the slopes 312A and 312B on the concave space 312 are also symmetrical, as the sliding cover 110 needs to slide in both up and down directions.

FIG. 5B shows that the concave space 312 has slid away and disengaged from the retention spring 130. The flat surface of the groove 112 depresses the retention spring 130 into the slot 425 on the edge 126 of the base plate 120 (see FIG. 4). Disengaging the concave space 312 from the retention spring 130 needs to overcome the urge of the spring force of retention spring 130. The slopes 130A and 130B on the retention spring 130 as well as the slopes 312A and 312B on the concave space 312 affect how much force is required to disengage the concave space 312 from the retention spring 130. The gentler the slopes the easier the disengagement. With proper selection of the retention spring 130 and proper arrangement of the slopes 130A, 130B, 312A and 312B, the engagement of the concave spaces 312 and the retention springs 130 can be made just enough to prevent a toddler from sliding open the sliding cover 110, while an older person can easily do so.

Referring again to FIGS. 5A and 5B, the concave space 312 on the groove 112 is just a ditch in an otherwise straight contour of the groove 112. Apparently when the wall of the groove 112 is thin enough the concave space 312 will include an opening on the wall of the groove 112 without affecting the function of the concave space 312. A skilled in the art may also recognize that the retention spring can be formed on the sliding cover and the corresponding concave space can be formed on the base plate, and their engagement can just as well hold the sliding cover in place. In fact, the important slopes 130A and 130B do not have to be part of the retention spring 130. A general spring loaded member may be employed as long as it has two sloped surfaces similar to the slopes 130A and 130B, respectively, and a spring urges the two sloped surfaces to protrude above the surface of the base plate.

Although the present invention discloses an embodiment with the electrical sockets 124 separated from the base plate 120, one having skills in the art would recognize that the sliding cover locking mechanism using the combination of the retention spring 130 and the concave space 312 may be applied to other types of electrical socket assemblies such as the one with the base plate 120 integrated to the electrical sockets 124.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. An electrical socket safety device, comprising:

a base plate for an electrical receptacle exposing a plurality of electrical sockets thereon;

a sliding plate slidably engaging the base plate for covering the plurality of electrical sockets, sliding the sliding plate away from the covering position exposing one or more of the plurality of electrical sockets;

at least one spring loaded member protruding above the surface of the base plate through a slot therein at the urge of a spring force of the spring loaded member, the protruding portion of the spring loaded member having a first and a second sloped surface for facilitating the depression of the spring loaded member into the slot in the base plate; and at least one concave space on the sliding plate for accommodating the protruding spring loaded member, a first border area of the concave space forcing the first sloped surface to depress the spring loaded member into the slot in the base plate when the sliding plate sliding in a first direction, a second border area of the concave space forcing the second sloped surface to depress the spring loaded member into the slot in the base plate when the sliding plate sliding in a second direction opposite to the first direction, wherein the sliding plate is held in a predetermined position through the engagement of the concave space on the sliding plate and the spring loaded member, sliding the sliding plate alone disengages the concave space on the sliding plate and the spring loaded member by overcoming the urge of the spring force of the spring loaded member through the facilitation of the first or second sloped surface on the spring loaded member, and the overcoming the urge of the spring force of the spring loaded member requires a predetermined force which is significantly greater than a child younger than 6 years of age can exert.

2. The electrical socket safety device of claim 1, wherein the sliding plate slidably engaging the base plate comprises two grooves formed on the sliding plate that fits two elongated edges on the base plate, respectively.

3. The electrical socket safety device of claim 2, wherein the slot is formed on the edge of the base plate, and the concave space is formed on the groove surface.

4. The electrical socket safety device of claim 1, wherein the sliding plate slidably engaging the base plate comprises two grooves formed on the base plate that fit two elongated edges on the sliding plate, respectively.

5. The electrical socket safety device of claim 1, wherein the spring loaded member comprises a wire spring formed in a "V" shape with an extended portion at each tip of the "V", the sides of the "V" forming the first and the second sloped surface of the spring loaded member, respectively, and the both ends of the extended portions of the wire spring being fastened to the base plate.

6. The electrical socket safety device of claim 1, wherein the spring loaded member comprises a plate spring formed in a "V" shape with an extended portion at each tip of the "V", the sides of the "V" forming the first and the second sloped surface of the spring loaded member, respectively, and the both ends of the extended portions of the wire spring being fastened to the base plate.

7. The electrical socket safety device of claim 1, wherein the concave space on the sliding plate includes an opening on the wall of the sliding plate.

8. The electrical socket safety device of claim 1, wherein the concave space includes a third and a fourth sloped surface, wherein the third sloped surface and the first sloped surface of the spring loaded member are approximately in parallel, and the fourth sloped surface and the second sloped surface of the spring loaded member are also approximately in parallel.

9. The electrical socket safety device of claim 1, wherein the first and the second sloped surface on the spring loaded member are approximately symmetrical.

10. The electrical socket safety device of claim 1, wherein the base plate is made of plastic material.

11. The electrical socket safety device of claim 1, wherein two spring loaded members on each side of the base plate and two concave spaces on each side of the sliding plate are formed, when all the four spring loaded members engaging all the four concave spaces, respectively, the sliding plate covers all the electrical sockets, and when only two of the spring loaded members engaging two of the concave spaces, respectively, the sliding plate exposes one of the electrical sockets.

12. An electrical socket safety device, comprising:

a base plate for an electrical receptacle exposing a plurality of electrical sockets thereon;

a sliding plate slidably engaging the base plate for covering the plurality of electrical sockets, sliding the sliding plate away from the covering position exposing one or more of the plurality of electrical sockets;

at least one spring loaded member protruding above the surface of the sliding plate through a slot therein at the urge of a spring force of the spring loaded member, the protruding portion of the spring loaded member having a first and a second sloped surface for facilitating the depression of the spring loaded member into the slot in the sliding plate; and at least one concave space on the base plate for accommodating the protruding spring loaded member, a first border area of the concave space forcing the first sloped surface to depress the spring loaded member into the slot in the sliding plate when the sliding plate sliding in a first direction, a second border area of the concave space forcing the second sloped surface to depress the spring loaded member into the slot in the sliding plate when the sliding plate sliding in a second direction opposite to the first direction, wherein the sliding plate is held in a predetermined position through the engagement of the concave space on the base plate and the spring loaded member, sliding the sliding plate alone disengages the concave space on the base plate and the spring loaded member by overcoming the urge of the spring force of the spring loaded member through the facilitation of the first or second sloped surface on the spring loaded member, and the overcoming the urge of the spring force of the spring loaded member requires a predetermined force which is significantly greater than a child younger than 6 years of age can exert.

13. The electrical socket safety device of claim 12, wherein the sliding plate slidably engaging the base plate comprises two grooves formed on the sliding plate that fits two elongated edges on the base plate, respectively.

14. The electrical socket safety device of claim 13, wherein the slot is formed on the edge of the sliding plate, and the concave space is formed on the groove surface.

15. The electrical socket safety device of claim 12, wherein the sliding plate slidably engaging the base plate comprises two grooves formed on the base plate that fit two elongated edges on the sliding plate, respectively.

16. The electrical socket safety device of claim 12, wherein the concave space includes a third and a fourth sloped surface, wherein the third sloped surface and the first sloped surface of the spring loaded member are approximately in parallel, and the fourth sloped surface and the second sloped surface of the spring loaded member are also approximately in parallel.

17. The electrical socket safety device of claim 12, wherein the first and the second sloped surface on the spring loaded member are approximately symmetrical.

18. The electrical socket safety device of claim 12, wherein the base plate is made of plastic material.

19. The electrical socket safety device of claim 12, wherein two spring loaded members on each side of the sliding plate and two concave spaces on each side of the base plate are formed, when all the four spring loaded members engaging all the four concave spaces, respectively, the sliding plate covers all the electrical sockets, and when only two of the spring loaded members engaging two of the concave spaces, respectively, the sliding plate exposes one of the electrical sockets.

* * * * *